US005918349A

United States Patent [19]

Leifeld et al.

[11] Patent Number: 5,918,349

[45] Date of Patent: Jul. 6, 1999

[54] CARDING MACHINE INCLUDING A DEVICE FOR ADJUSTING THE DISTANCE BETWEEN FLAT BARS AND CARDING CYLINDER

[75] Inventors: Ferdinand Leifeld, Kempen; Bernhard Kohnen, Tonisvorst, both of Germany

[73] Assignee: Trützschler GmbH & Co. KG, Mönchengladbach, Germany

[21] Appl. No.: 08/988,422

[22] Filed: Dec. 10, 1997

[30] Foreign Application Priority Data

Dec. 13, 1996 [DE] Germany ..... 196 51 894

[51] Int. Cl.[6] ..... D01G 15/30

[52] U.S. Cl. ..... 19/103

[58] Field of Search ..... 19/99, 102, 103, 19/104, 113

[56] References Cited

U.S. PATENT DOCUMENTS

| | | | |
|---|---|---|---|
| 494,422 | 3/1893 | Hitchon | 19/103 |
| 1,302,109 | 4/1919 | Whitin | 19/102 |
| 5,625,924 | 5/1997 | Sauter et al. | 19/103 |

FOREIGN PATENT DOCUMENTS

| | | | |
|---|---|---|---|
| 476407 | 3/1992 | European Pat. Off. | 19/102 |
| 25 47 728 | 4/1976 | Germany . | |
| 2741089 | 3/1979 | Germany | 19/102 |
| 36 01 906 | 8/1987 | Germany . | |
| 39 13 996 | 8/1990 | Germany . | |
| 42 35 610 | 4/1994 | Germany . | |
| 2254624 | 10/1992 | United Kingdom | 16/102 |

*Primary Examiner*—Ismael Izaguirre
*Attorney, Agent, or Firm*—Venable; Gabor J. Kelemen

[57] ABSTRACT

A carding machine includes a main carding cylinder having a cylinder axis and a cylinder clothing; and traveling flats cooperating with the main carding cylinder along a circumferential length portion thereof. The traveling flats include a plurality of flat bars each having a flat bar clothing cooperating with the cylinder clothing; and a drive for moving the flat bars in unison in an endless path having a working leg in which the flat bar clothings cooperate with the cylinder clothing and a return leg. The working leg extends circumferentially about a portion of the main carding cylinder. The carding machine further has a flexible bend having a convex surface and being supported on the machine frame laterally of the main carding cylinder; and a slide guide supported on the flexible bend. The slide guide has a convex surface supporting the flat bars for sliding motion thereon along the working leg. The radial position of the convex surface of the slide guide relative to the cylinder axis determines the radial clothing point distance between the clothing points of the flat bar clothings and the clothing points of the cylinder clothing. Further, an adjusting device is provided for radially displacing the slide guide such that the radial clothing point distance remains uniform at all locations along the working leg.

21 Claims, 9 Drawing Sheets

CARDING MACHINE INCLUDING A DEVICE FOR ADJUSTING THE DISTANCE BETWEEN FLAT BARS AND CARDING CYLINDER

CROSS REFERENCE TO RELATED APPLICATION

This application claims the priority of German Application No. 196 51 894.6 filed Dec. 13, 1996, which is incorporated herein by reference.

BACKGROUND OF THE INVENTION

This invention relates to a carding machine for processing textile fibers such as cotton, chemical fibers or the like and includes travelling flats composed of flat bars provided with a clothing. Between the points of the flat bar clothings and the points of the carding cylinder clothing a clearance is maintained through which the fiber material passes as it is being treated by the clothings. Opposite ends of the flat bars glide on convex slide guides each formed of a flexible element positioned on a convex surface of the associated flexible bend.

In a known arrangement the distance between the convex outer surface of the slide guide on the one hand and the concave inner surface of the slide guide and the convex outer surface of the flexible bend on the other hand, is constant along the circumferential direction of the carding cylinder. The convex outer surface and the concave inner surface of the slide guide and the convex outer surface of the flexible bend are arranged concentrically to the rotary axis of the main carding cylinder. The flexible bend has a recess, for example, a groove in which the slide guide is stationarily supported. In order to vary the distance between the points of the flat bar clothings and the points of the cylinder clothing for the purpose of altering the carding intensity, because, for example, the nep number has increased and/or a fiber shortening in the fiber web has occurred, the position of the flexible bend is altered by adjusting a plurality of setscrews, to thus change the position of the slide guide. This operation results in a raising or lowering of the flat bars, thus changing the distance between the points of the flat bar clothings, on the one hand, and the points of the carding cylinder clothing, on the other hand. Such an adjusting process of the flexible bend is, however, circumstantial. It is a further disadvantage of the conventional arrangement that the geometry of the flexible bend depends from the number of the setscrews. Further, for effecting the change, the carding machine has to be at a standstill and lateral carding elements such as drive, suction arrangement and flat bars have to be removed and subsequently reassembled. Such an operation involves a significant outlay of the assembling operation. It is also a drawback that because of the necessary standstill, the production of the carding machine is interrupted.

SUMMARY OF THE INVENTION

It is an object of the invention to provide an improved device of the above-outlined type from which the discussed disadvantages are eliminated and which permits, while the carding machine is operating, an adjustment of the distance between the clothing points of the flat bars and the clothing points of the carding cylinder in a simple manner, particularly for the purpose of altering the carding intensity.

This object and others to become apparent as the specification progresses, are accomplished by the invention, according to which, briefly stated, the carding machine includes a main carding cylinder having a cylinder axis and a cylinder clothing; and traveling flats cooperating with the main carding cylinder along a circumferential length portion thereof. The traveling flats include a plurality of flat bars each having a flat bar clothing cooperating with the cylinder clothing; and a drive for moving the flat bars in unison in an endless path having a working leg in which the flat bar clothings cooperate with the cylinder clothing and a return leg. The working leg extends circumferentially about a portion of the main carding cylinder. The carding machine further has a flexible bend having a convex surface and being supported on the machine frame laterally of the main carding cylinder; and a slide guide supported on the flexible bend. The slide guide has a convex surface supporting the flat bars for sliding motion thereon along the working leg. The radial position of the convex surface of the slide guide relative to the cylinder axis determines the radial clothing point distance between the clothing points of the flat bar clothings and the clothing points of the cylinder clothing. Further, an adjusting device is provided for radially displacing the slide guide such that the radial clothing point distance remains uniform at all locations along the working leg.

By virtue of the invention the carding intensity may be varied automatically during operation as a function of technological magnitudes such as nep number and/or fiber damage (fiber shortening). It is an additional particular advantage of the invention that after adjustment of the slide guide the distance between the clothing points of the flats and the clothing points of the cylinder remain identical as viewed circumferentially, whereby a significant improvement of the produced sliver is achieved. Advantageously, the slide guide is flexible to ensure that the arcuate shape of the outer surface of the slide guide is adaptable so that in this manner the uniformity of the distance between the flats clothing and the cylinder clothing is securely maintained at all locations over the circumference. It is a further advantage of the invention that the adjustment may be effected continuously during operation, either automatically or by actuating a push-button, thus eliminating the need for any time-consuming assembling operation or down time. It is a further particular advantage of the invention that the convex outer surface of the slide guide—on which the flat bar heads are supported—is, on either side of the carding machine, shifted in a radial direction concentrically to the axis of the carding cylinder by camming action of elements which are displaced relative to one another in the circumferential direction, parallel to the cylinder surface. In this manner the radial position of the flat bar-supporting slide guide may be changed by infinitely small increments.

The invention has the following additional advantageous features:

The distance between the convex outer surface and the concave inner surface of the slide guide changes as viewed in a circumferential direction and, at the same time, the distance between the convex supporting surface of the flexible bend (on which the slide guide is positioned) and the cylinder axis changes with an opposite sign as viewed in the same circumferential direction so that the sum of the two distances at all locations along the circumference is constant. A relative displacement between the slide guide and the flexible bend in the circumferential direction causes, by camming action, a radial shift of the slide guide and thus the radial position of the flat bars and hence the distance between the points of the flat bar clothings and the points of the cylinder clothing is altered.

In another advantageous embodiment where the distance between the convex outer surface and the concave inner surface of the slide guide is circumferentially constant, an intermediate member is provided between the slide guide and the supporting surface of the flexible bend, and the distance between the convex outer surface and the concave inner surface of the intermediate member changes as viewed in a circumferential direction and, at the same time, the distance between the convex supporting surface of the flexible bend (on which the intermediate member is positioned) and the cylinder axis changes with an opposite sign as viewed in the same circumferential direction so that the sum of the two distances at all locations along the circumference is constant. A relative displacement between the intermediate member and the flexible bend in the circumferential direction causes, by camming action, a radial shift of the slide guide and thus the radial position of the flat bars and hence the distance between the points of the flat bar clothings and the points of the cylinder clothing is altered.

In another advantageous embodiment where the distance between the convex outer surface and the concave inner surface of the flexible bend is circumferentially constant, an intermediate member is provided between the slide guide and the supporting surface of the flexible bend, and the distance between the convex outer surface and the concave inner surface of the slide guide changes as viewed in a circumferential direction and, at the same time, the distance between the convex supporting surface of the intermediate member (on which the slide guide is positioned) and the cylinder axis changes with an opposite sign as viewed in the same circumferential direction so that the sum of the two distances at all locations along the circumference is constant. A relative displacement between the intermediate member and the slide guide in the circumferential direction causes, by camming action, a radial shift of the slide guide and thus the radial position of the flat bars and hence the distance between the points of the flat bar clothings and the points of the cylinder clothing is altered.

According to another preferred embodiment of the invention in which the distance between the convex outer surface and the concave inner surface of the slide guide as well as the distance between the convex outer surface and the concave inner surface of the flexible bend are constant, first and second superposed intermediate members are provided between the slide guide and the supporting surface of the flexible bend, and the distance between the convex outer surface and the convex inner surface of the first intermediate member changes in the circumferential direction and the distance between the convex outer surface of the second intermediate member and the axis of the carding cylinder changes with an opposite sign in the same circumferential direction, so that the sum of both distances at all locations is constant along the circumference. A relative displacement between the first and second intermediate members causes, by camming action, a radial shift of the slide guide and thus the radial position of the flat bars and hence the distance between the points of the flat bar clothings and the points of the cylinder clothing is altered.

The intermediate member or members are formed by a flexible element, such as a metal ribbon (for example, a steel ribbon).

The slide guide and/or the intermediate member or members are made of a synthetic material which has a low coefficient of friction and which is reinforced, for example, by glass fibers, carbon fibers or the like.

The slide guide and/or the intermediate member or members are made of a flexible metal band (for example, a steel band).

The intermediate member, the concave inner surface of the slide guide, the concave supporting surface of the flexible bend and/or the bottom surface of the groove are shaped by machining, for example, grinding.

A displacing device, including a motor and setting elements (such as a linkage, a toothed rack, a gear, rotary joints and the like) is provided for circumferentially shifting the slide guide and/or the intermediate member or members and/or the flexible bend.

The displacing device engages essentially the middle of the slide guide and/or the intermediate member or members.

Between the slide guide and/or the intermediate member or members and the driving device a transmission element is provided.

The ends of the slide guide and/or the intermediate member or members are secured to driven winches.

The slide guide and/or the intermediate member or members are endless belts looped around at least two support rollers, at least one of which is driven, for example, by a motor.

Externally of the flexible bend the slide guide and/or the intermediate member or members have teeth meshing with a driven gear.

The slide guide cooperates with a band-like element which essentially has the shape of an arcuately bent wedge; the slide guide and the band-shaped element are circumferentially displaceable.

The driving device, for example, a motor, for displacing the slide guide and/or the intermediate member or members and/or the flexible bend is connected to an electronic control and regulating device, such as a microcomputer.

Measuring members for detecting fiber lengths, the nep number and the distance between the points of the flat clothings and the points of the carding cylinder clothing are connected to the electronic control and regulating device.

A switching element for actuating the driving device is connected to the electronic control and regulating device.

DESCRIPTION OF THE PREFERRED EMBODIMENTS

Figure 1:
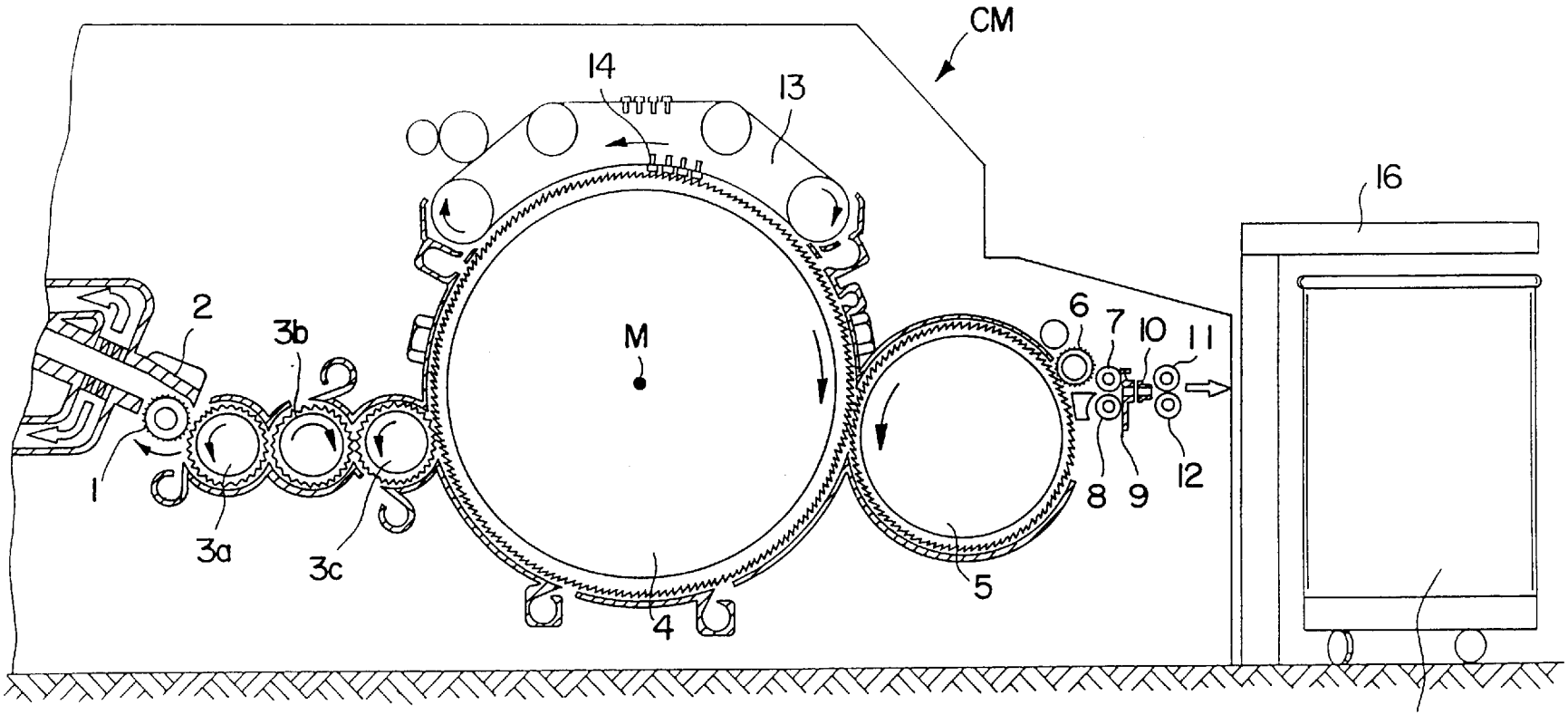
FIG. 1 is a schematic side elevational view of a carding machine adapted to incorporate the device according to the invention.

FIG. 1 shows a carding machine CM which may be an EXACTACARD DK 803 model manufactured by Tr ützschler GmbH & Co. KG, Mönchengladbach, Germany. The carding machine CM has a feed roller 1, a feed plate 2 cooperating therewith, lickerins 3*a*, 3*b*, 3*c*, a main carding cylinder 4 having a rotary axis M, a doffer 5, a stripping roll 6 cooperating with the doffer 5, cooperating crushing rolls 7, 8, a web guiding element 9, a sliver trumpet 10, cooperating calender rolls 11, 12, travelling flats 13 including flat bars 14, a coiler can 15 and a sliver coiler 16. The direction of rotation of the various rolls is indicated by respective curved arrows.

Figure 2:
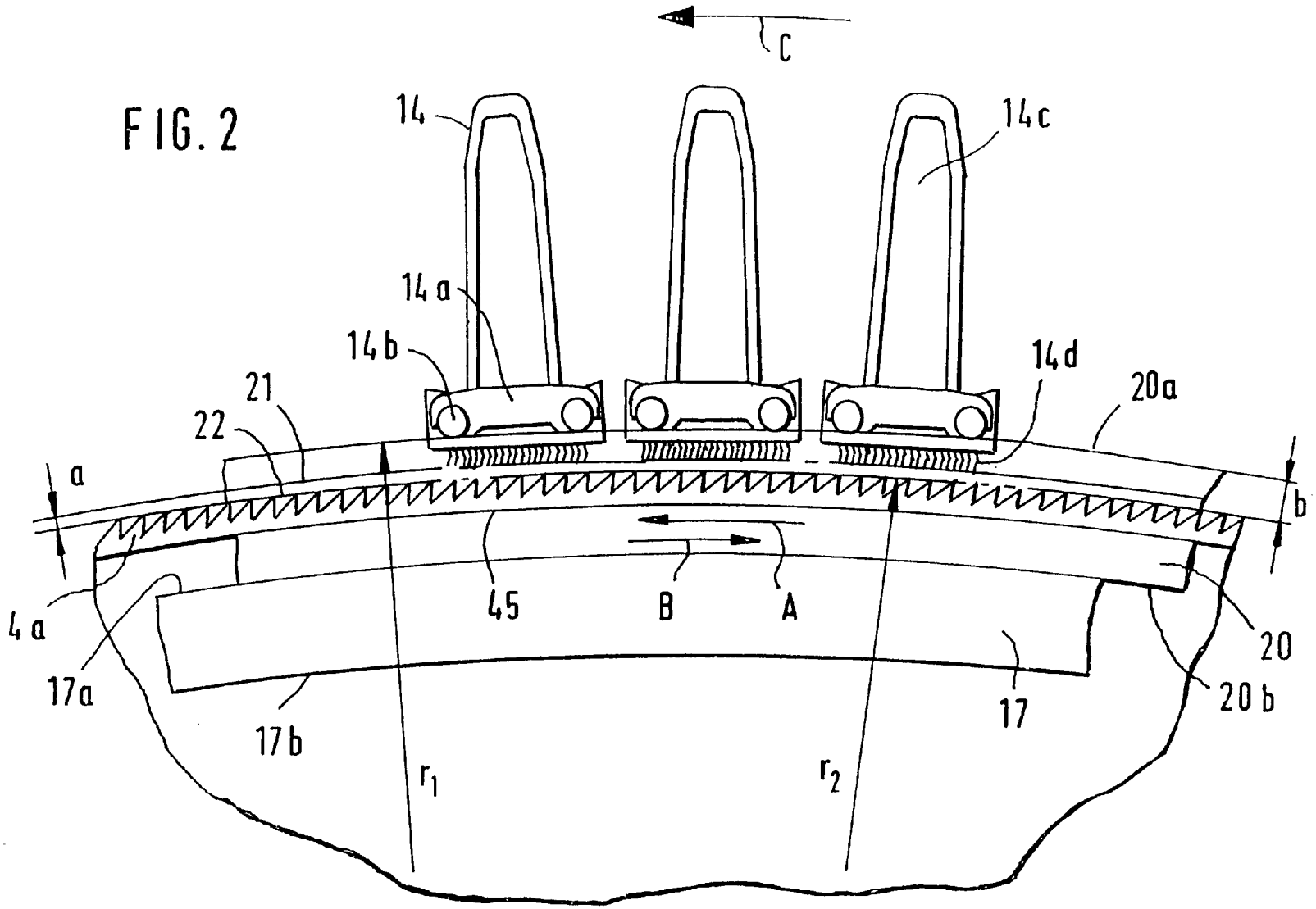
FIG. 2 is a fragmentary schematic side elevational view of a carding cylinder, travelling flats and support therefor.
Figure 7A:
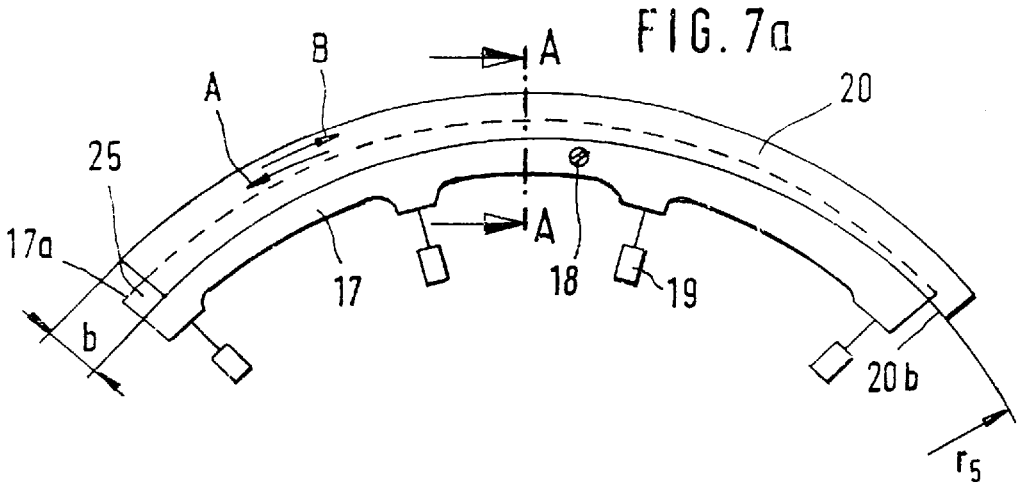
FIG. 7*a* is a schematic side elevational view of a flexible bend and a slide guide received in a groove thereof.

Turning to FIG. 2, a flexible bend 17 is secured by screws 18 to the machine frame at opposite sides of the carding machine as also shown in FIG. 7*a*. The flexible bend has a plurality of setscrews 16 (shown in FIGS. 7*a* and 10). The flexible bend 17 further has a convex outer surface 17*a* and an underside 17*b*. Above the flexible bend 17 a slide guide 20 made, for example, of a low-friction synthetic material is disposed which has a convex outer surface 20*a* and a concave inner surface 20*b*. The concave inner surface 20*b* lies on the convex outer surface 17*a* of the flexible bend 17 and may slide circumferentially thereon in the direction of the arrows A and B. The flat bars 14 have, at opposite ends, a bar head 14*a* from which extend a pair of steel pins 14*b* which slide on the convex outer surface 20*a* of the slide guide 20 in the direction of the arrow C. A clothing 14*d* is secured to the underface of the carrier body 14*c* of the flat bar 14. The points of the clothing 14*d* of the flat bars 14 lie on an imaginary circle 21. The carding cylinder 4 carries on its circumference a cylinder clothing 4*a*, such as a sawtooth clothing. The points of the cylinder clothing 4*a* lie on an imaginary circle 22. The distance between the circles 21 and 22 is designated at a and is, for example, 0.20 mm. The distance between the convex outer surface 20*a* and the circle 22 is designated at b. The radius of the convex outer surface 20*a* is designated at $r_1$ while the radius of the circle 22 is designated at $r_2$. The radii $r_1$ and $r_2$ intersect the cylinder axis M (FIG. 1).

Figure 3:
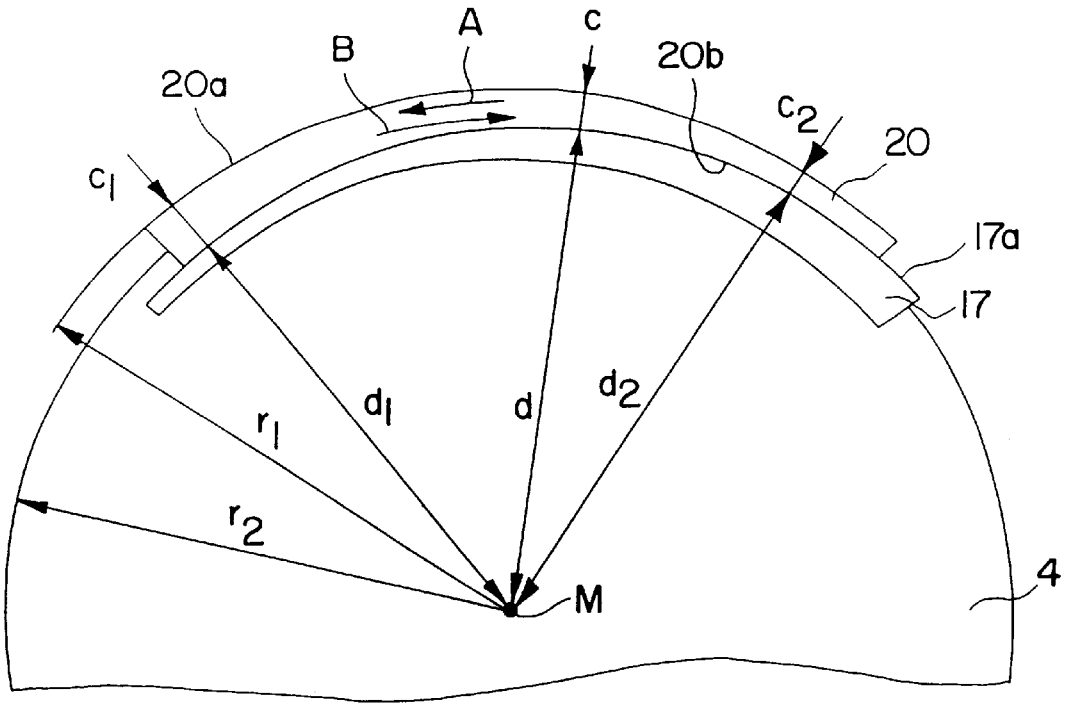
FIG. 3 is a schematic side elevational view of a preferred embodiment of the invention, showing a flexible bend and a shiftable slide guide.

In the embodiment of FIG. 3 the slide guide 20, forming a first elongated element, is circumferentially shiftable on the flexible bend 17, forming a second elongated element. The distance between the convex outer surface 20*a* and the concave inner surface 20*b* (that is, the radially measured thickness) of the slide guide 20 decreases from $c_1$ to $c_2$ as viewed in the circumferential direction B whereas the distance between the convex outer surface 17*a* and the axis M of the carding cylinder 4 increases from $d_1$ to $d_2$ as viewed in the circumferential direction B such that c+d is constant at all circumferential locations. To achieve such a relationship, the slide guide 20 and the flexible bend 17 have the shape of a circularly bent wedge which are superposed on one another in oppositely oriented wedge directions. The concave inner surface 20*b* and the convex outer surface 17*a* are in sliding contact with one another. The central axis of the convex outer surface 20*a* coincides with the rotary axis M of the carding cylinder 4. The central axis of the concave inner surface 20*b* and the convex outer surface 17*a*, on the other hand, lie externally of the rotary axis M of the carding cylinder 4. It is thus seen that by circumferentially shifting the slide guide 20, it is, by camming action, displaced radially, whereby the radial position of the outer convex supporting surface 20*a* is altered.

Figure 4:
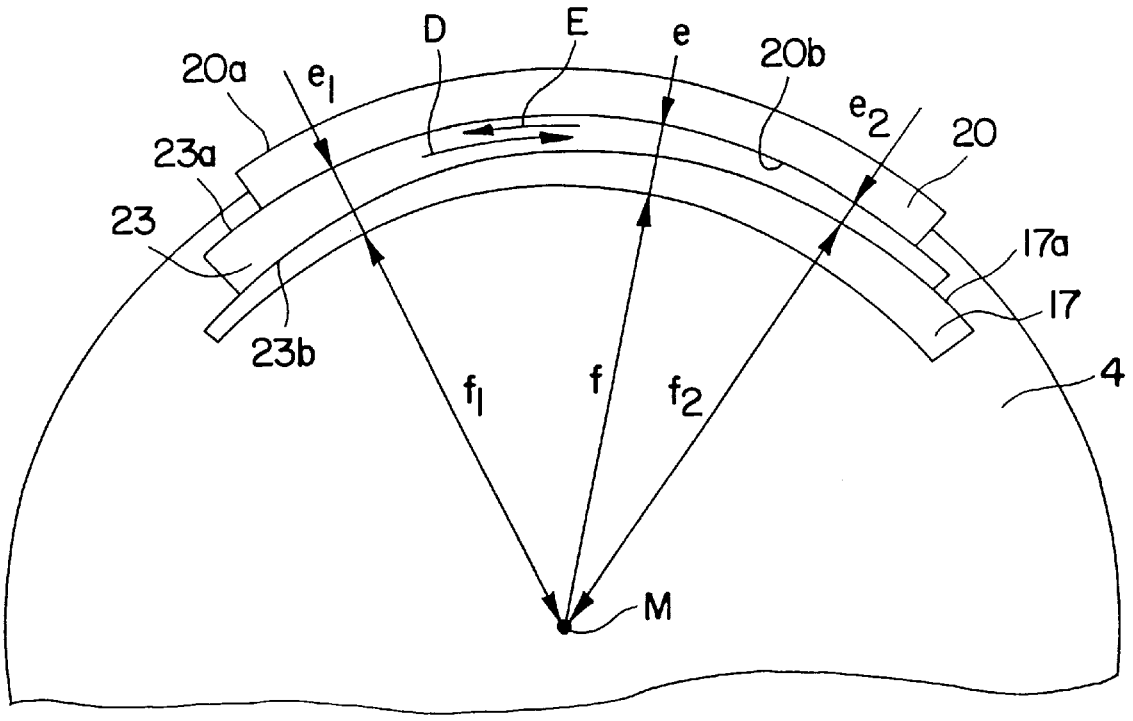
FIG. 4 is a schematic side elevational view of another preferred embodiment of the invention, showing a flexible bend, a slide guide and a shiftable intermediate member.

According to the embodiment of FIG. 4, between the concave inner surface 20*b* of the slide guide 20 and the concave outer surface 17*a* of the flexible bend 17, forming a second elongated element, an intermediate member 23, forming a first elongated element, is provided which is circumferentially displaceable in the direction of the arrows D and E. The distance between the convex outer surface 20*a* and the convex inner surface 20*b* is constant, that is, the slide guide 20 has a constant radial thickness as viewed circumferentially. The distance between the convex outer surface 23*a* and the concave inner surface 23*b* of the intermediate member 23 decreases in the circumferential direction D from $e_1$ to $e_2$, whereas the distance between the convex supporting surface 17*a* and the rotary axis M of the carding cylinder 4 increases in the circumferential direction D from $f_1$ to $f_2$ such that e+f is constant at any circumferential location. The axes of the convex outer surface 20*a* and the concave inner surface 20*b* coincide with the rotary axis M of the carding cylinder 4, while the axes of the concave inner surface 23*b* and the convex outer surface 17*a* lie externally of the rotary axis M of the carding cylinder 4. To achieve such a relationship, the intermediate member 23 and the flexible bend 17 are shaped as oppositely oriented, circularly bent wedges. The concave inner surface 20*b* and the convex outer surface 23*a* on the one hand and the concave inner surface 23*b* and the convex outer surface 17*a* are in sliding contact with one another. It is thus seen that by circumferentially shifting the intermediate member 23, the slide guide 20 is, by camming action, displaced radially, whereby the radial position of the outer convex supporting surface 20*a* of the slide guide 20 is altered.

Figure 5:
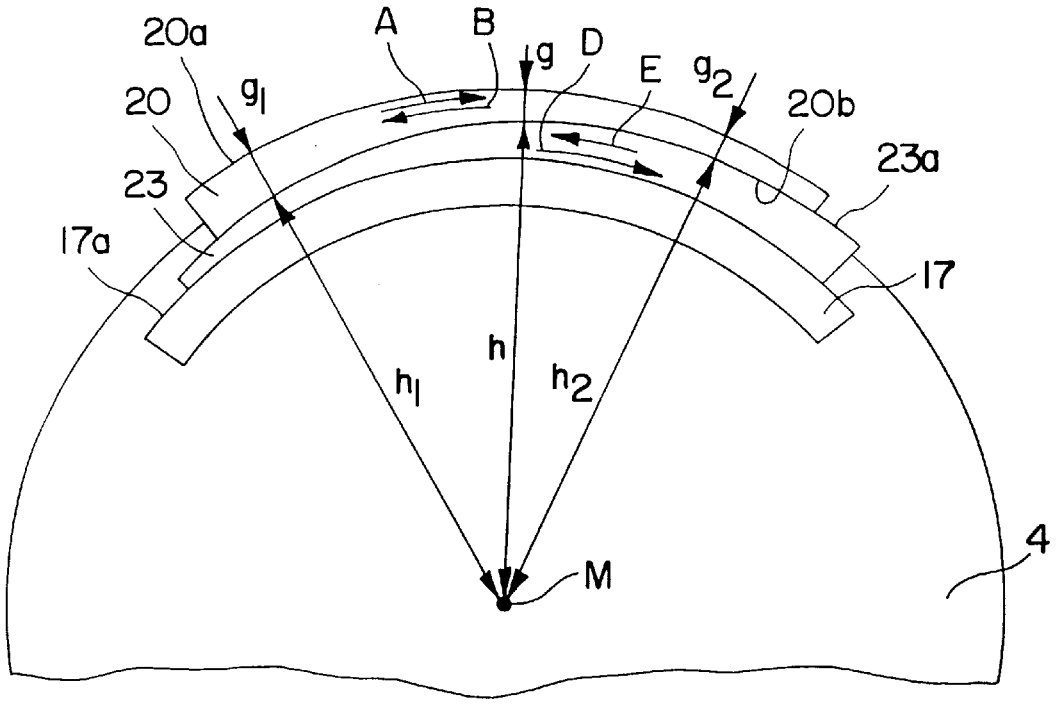
FIG. 5 is a schematic side elevational view of yet another preferred embodiment of the invention, showing a flexible bend, a shiftable slide guide and a shiftable intermediate member.

In the embodiment according to FIG. 5, between the concave inner surface 20*b* of the slide guide 20, forming a first elongated element, and concave outer surface 17*a* of the flexible bend 17 an intermediate member 23, forming a second elongated element, is provided. The slide guide 20 is displaceable in the circumferential directions A and B and the intermediate member 23 is displaceable in the circumferential directions D and E. The distance between the convex outer surface 20*a* and the convex inner surface 20*b* of the slide guide 20 decreases in the circumferential direction A from $g_1$ to $g_2$, while the distance between the convex outer surface 23*a* of the intermediate member 23 and the rotary axis M of the carding cylinder 4 increases from $h_1$ to $h_2$ such that g+h is constant at any location along the circumference. The central axis of the convex outer surface 20*a* and the central axis of the convex outer surface 17*a* coincide with the rotary axis M of the carding cylinder 4. The axis of the concave inner surface 20*b* and the central axis of the concave outer surface 23*a* lie externally of the rotary axis M of the carding cylinder 4. To achieve such a relationship, the slide guide 20 and the intermediate member 23 are oppositely oriented, circularly bent wedge shape members. The concave inner surface 20*b* and the convex outer surface 23*a* are in a sliding contact with one another. It is thus seen that by circumferentially shifting the intermediate member 23 and the slide guide 20, the latter is, by camming action, displaced radially, whereby the radial position of the outer convex supporting surface 20*a* of the slide guide 20 is altered.

Figure 6:
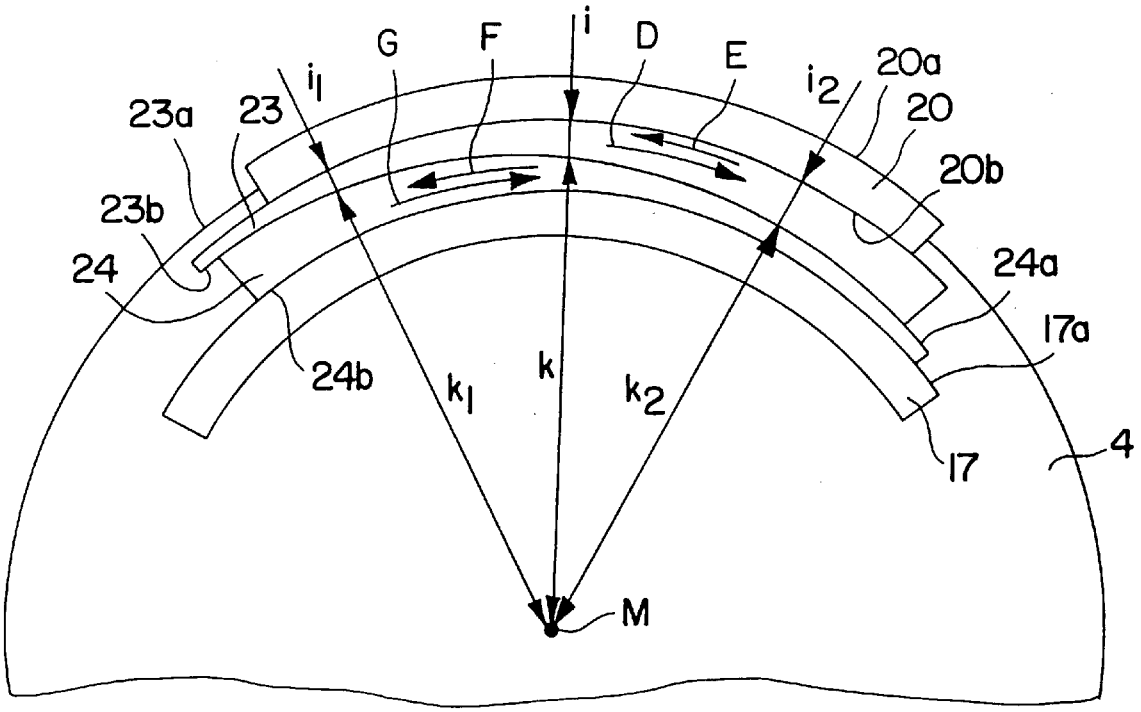
FIG. 6 is a schematic side elevational view of a further preferred embodiment of the invention, showing a flexible bend with two shiftable intermediate members.

In the embodiment according to FIG. 6, between the concave inner surface 20*b* of the slide guide 20 and the convex outer surface 17*a* of the flexible bend 17 two intermediate members 23 and 24 are provided which form first and second elongated elements, respectively. The distance between the convex outer surface 20*a* and the concave inner surface 20*b* is constant, similarly to the FIG. 4 embodiment. The intermediate members 23 and 24 are displaceable in the direction D, E and F, G, respectively. The distance between the convex outer surface 23*a* and the convex inner surface 23*b* of the first intermediate member 23 increases from $i_1$ to $i_2$, whereas—as viewed in the same direction—the distance between the concave outer surface 24*a* of the second intermediate member 24 and the rotary axis M of the carding cylinder 4 decreases from $k_1$ to $k_2$ such that i+k is constant at each location along the circumference. The axes of the convex outer surface 20*a*, the concave inner surface 20*b* and the convex outer surface 17*a* coincide with the rotary axis M of the carding cylinder 4. The axes of the concave inner surface 23*b* and the concave outer surface 24*a*, on the other hand, lie externally of the rotary axis M of the carding cylinder 4. To achieve these relationships, the first and second intermediate members 23 and 24 have the shape of circularly bent wedges which are superposed in an oppositely oriented fashion. The concave inner surface 23*b* and the concave outer surface 24*a* are in a sliding contact with one another. It is thus seen that by circumferentially shifting the intermediate members 23 and 24, the slide guide 20 is, by camming action, displaced radially, whereby the radial position of the outer convex supporting surface 20*a* of the slide guide 20 is altered.

The distances c through k in the embodiments described above in connection with FIGS. 3 through 6 change preferably uniformly as viewed in the circumferential direction.

Figure 7B:
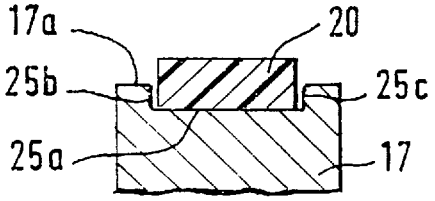
FIG. 7*b* is a sectional view taken along line VIIb—VIIb of FIG. 7*a*.

Turning to FIG. 7*a*, the flexible bend 17 is provided with a groove 25 having a bottom surface 25*a*. The slide guide 20 which is made of an elastic, low-friction synthetic material, is, as shown in FIG. 7*b*, received in the groove 25 such that one part of the slide guide 20 projects beyond the convex outer surface 17*a* of the flexible bend 17. The slide guide 20 is displaceable within the groove 25 in the direction of the arrows A, B whereby the concave inner surface 20*b* of the slide guide 20 glides along the bottom surface 25*a* of the groove 25. The lateral surfaces 25*b* and the 25*c* of the groove 25 form lateral guides for the slide guide 20. The functioning of the arrangement of FIGS. 7*a* and 7*b* corresponds, for example, to that shown in FIG. 3.

Figure 8A:
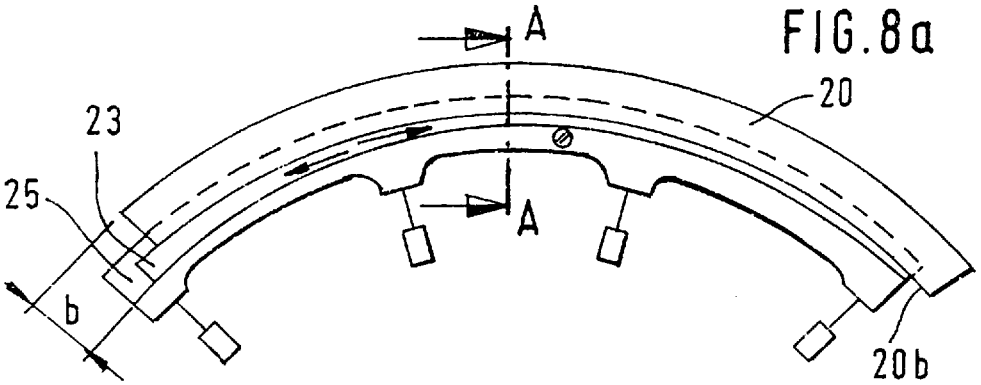
FIG. 8*a* is a schematic side elevational view of a flexible bend as well as an intermediate member and a slide guide nested in a groove of the flexible bend.
Figure 8B:
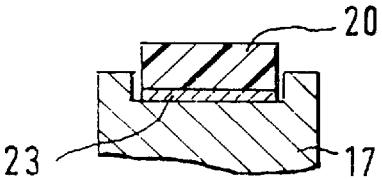
FIG. 8*b* is a sectional view taken along line VIIIb—VIIIb of FIG. 8*a*.

Turning to FIG. 8*a*, within the groove 25, between the concave inner surface 20*b* and the bottom surface 25*a* of the groove 25 a displaceable intermediate member 23 is provided as shown in cross section in FIG. 8*b*. The arrangement of FIG. 8*a* and 8*b* corresponds in function, for example, to the construction shown in FIG. 4.

Figure 9A:
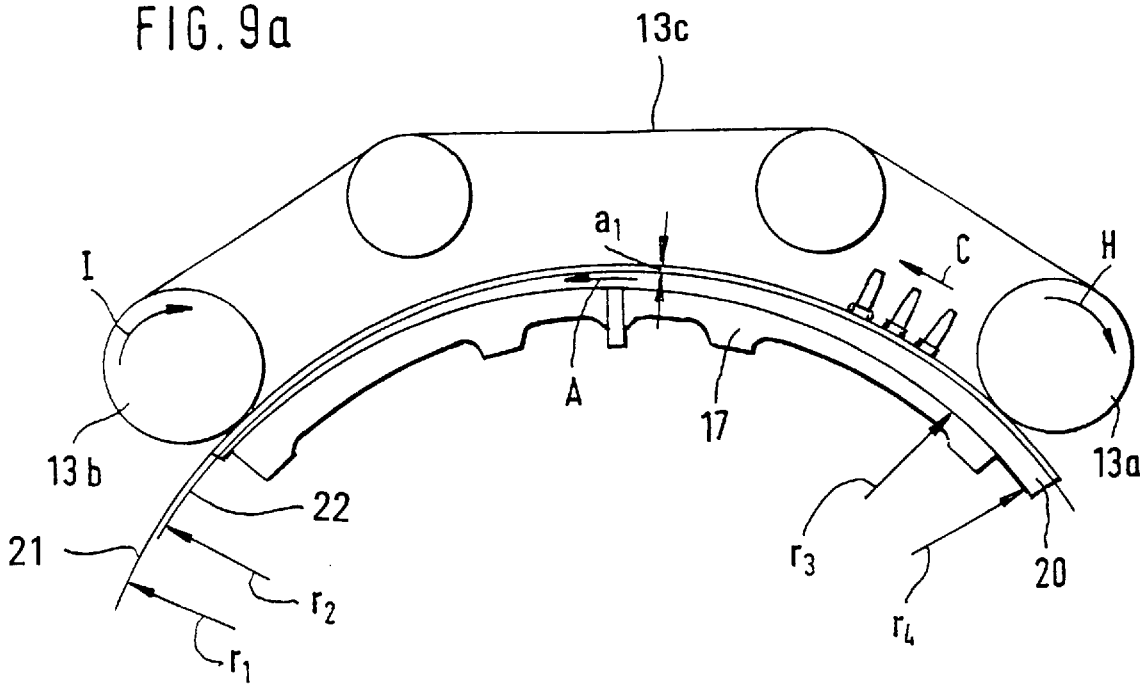
FIG. 9*a* is a schematic side elevational view of a flexible bend, a slide guide depicted in a first position and travelling flats supported on the slide guide.
Figure 9B:
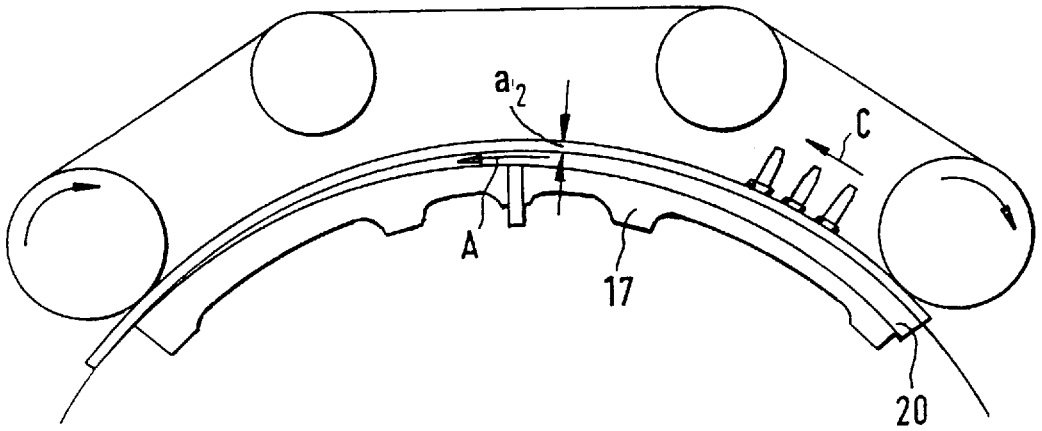
FIG. 9*b* is an illustration similar to FIG. 9*a* showing the slide guide in a second position.

In FIGS. 9*a* and 9*b* the circumferential displacement of the slide guide 20 on the flexible bend 17 is shown to take place in the direction of the arrow A. By means of such a displacement, for example, by a distance of 50 mm, the distance a between the points of the flat bar clothings 14*d* and the points of the cylinder clothing 4*a*, that is, the distance between the imaginary circles 21 and 22 is increased from $a_1$ (for example, 0.30 mm) to $a_2$ (for example, 0.5 mm). The flat bars 14 are slowly driven in a closed path by a drive belt 13*c* in the direction C along a working leg from the end roller 13*a* to the end roller 13*b*. During the travel along the working leg, the flat bars 14 glide on the slide guide 20 and their clothings 14*d* cooperate with the clothing 4*a* of the main carding cylinder 4 in processing the fiber material. At the end of the working leg, the travelling flats 14 are reversed by the roller 13*b* to travel back, along a return leg, towards the end roller 13*a*. The radius of the convex outer surface 17*a* of the flexible bend 17 is designated at $r_3$ and the radius of the concave inner surface 20*b* of the slide guide 20 is designated at $r_4$. The end rollers 13*a* and 13*b* rotate in the direction of arrows H and I, respectively.

Figure 10:
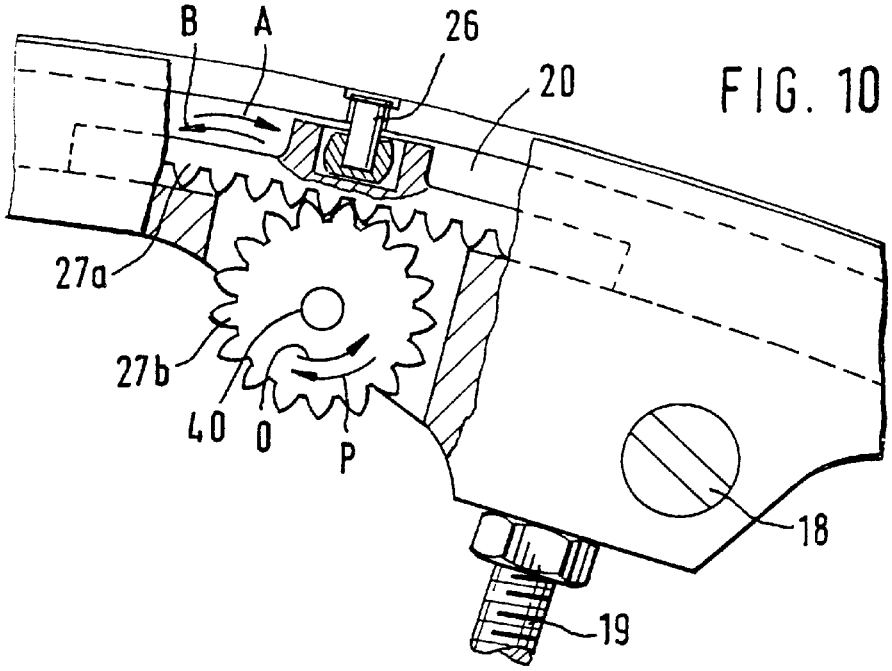
FIG. 10 is a side elevational view of a rack-and-pinion drive for circumferentially shifting the slide guide.

Turning to FIG. 10, a toothed rack 27*a* which is attached to the slide guide 20 by a carrier element 26, meshes with a driving pinion 27*b* rotatable in the directions O or P. The pinion 27*b* is driven by a non-illustrated reversible motor to cause the slide guide 20 to be circumferentially shifted in the direction of the arrows A or B.

Figure 11:
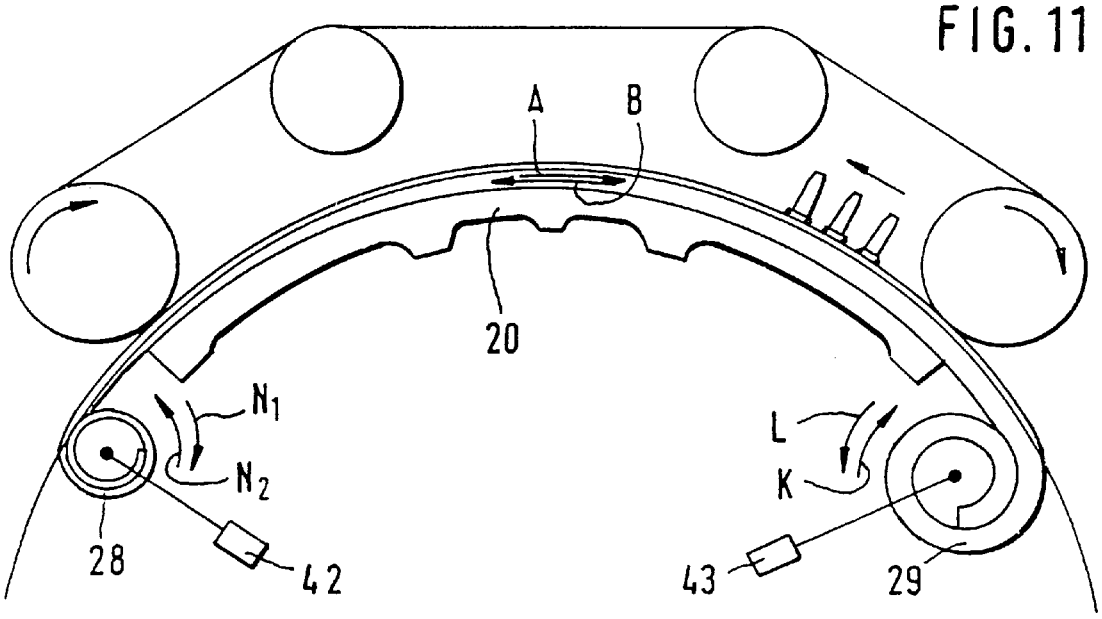
FIG. 11 is a schematic side elevational view of a slide guide and winches arranged at opposite ends thereof.

Turning to FIG. 11, both end portions of the slide guide 20 are flexible and are wound on respective winches 28 and 29 which may be driven by motors 42 and 43 in the direction of the arrows K, L and $N_1$, $N_2$, respectively.

Figure 12:
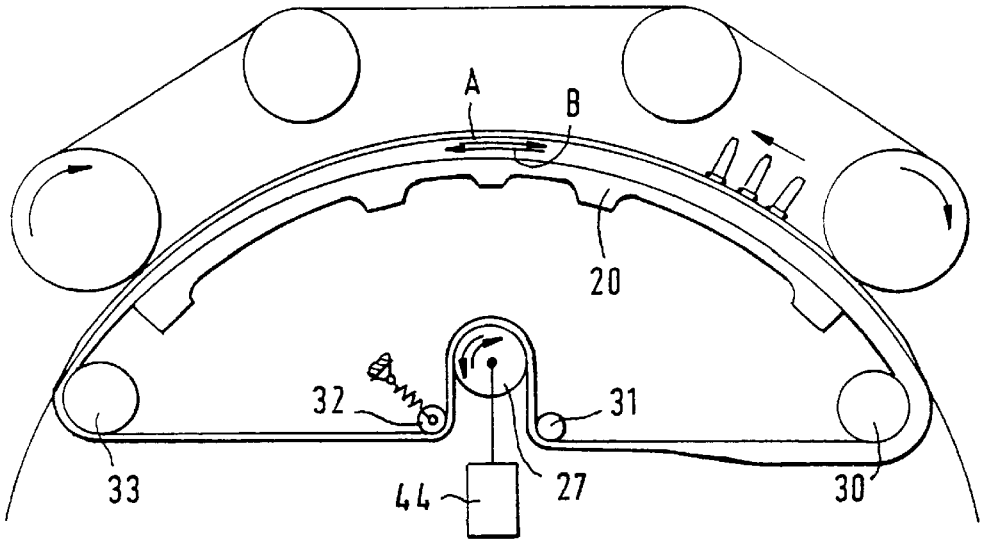
FIG. 12 is a schematic side elevational view of a slide guide formed as an endless circulating band element.

In the construction shown in FIG. 12 the slide guide 20 is an endless band circulating about support rollers 27, 30, 31, 32 and 33. A reversible motor 44 directly drives the roller 27 selectively in the one or the other direction, whereby the slide guide 20 is circumferentially displaced in the direction of the arrows A or B.

While in the various displacing mechanisms described above in connection with FIGS. 10–12 the displaced component is the slide guide 20, it is to be understood that any of these displacing mechanisms is applicable to the other disclosed displaceable elements, for example, the intermediate members 23 and/or 24.

Figure 13:
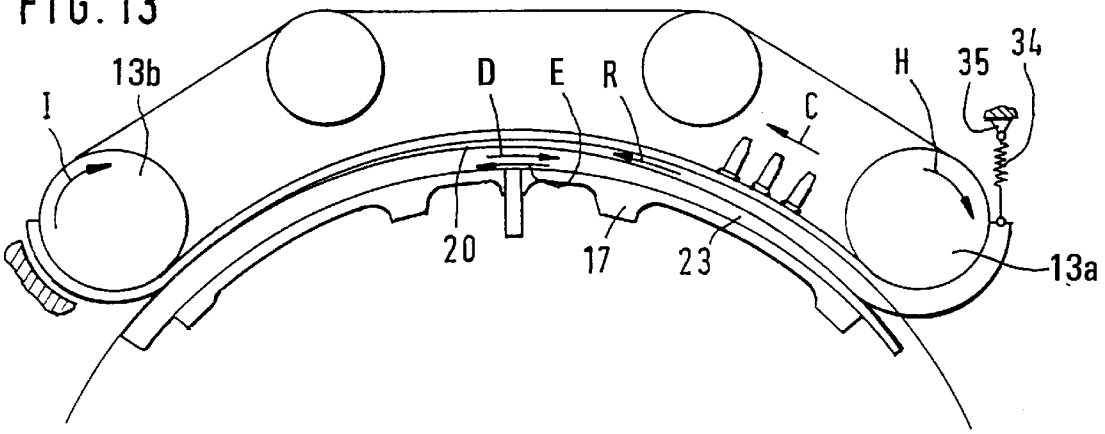
FIG. 13 is a schematic side elevational view of a spring loaded slide guide.

Turning to FIG. 13, the slide guide 20 is secured at one end to a stationary support 35 with the intermediary of a tension spring 34. By means of the driven end roller 13*b* of the travelling flats a tension force is imparted on the slide guide 20 in the direction R. Between the slide guide 20 and the flexible bend 17 an intermediate member 23 is provided which is displaceable in the direction of the arrows D or E as shown in FIG. 5.

Figure 14:
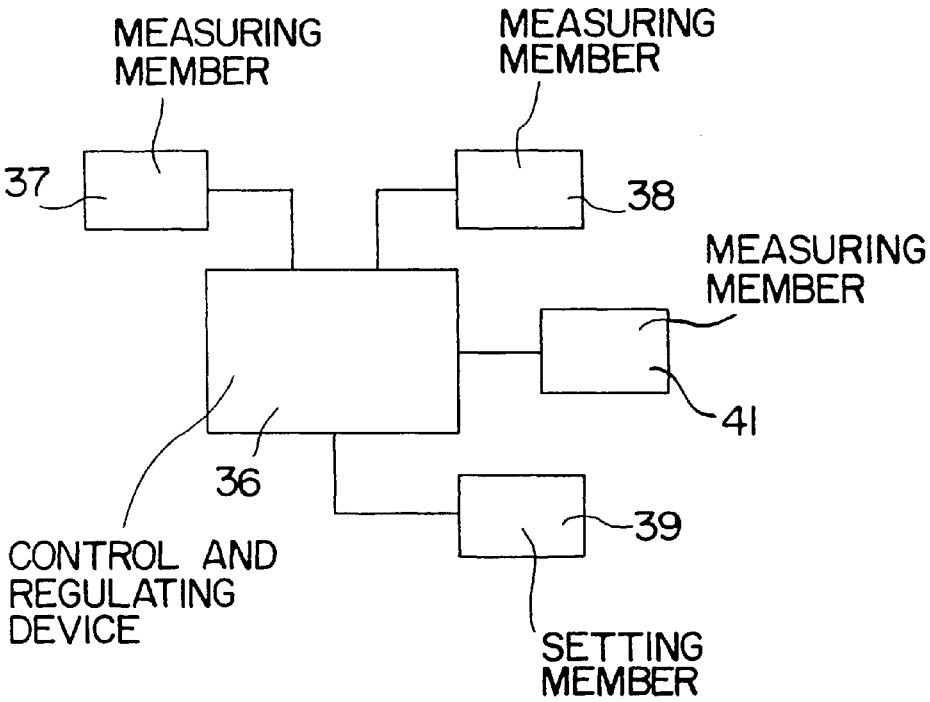
FIG. 14 is a block diagram of an electronic control and regulating device to which there are connected at least one nep sensor, a fiber length sensor and a setting device, such as a motor for changing the position of the slide guide.

Turning to FIG. 14, a measuring member 37 such as a NEP CONTROL NCT manufactured by Trützschler GmbH & Co. KG for the automatic detection of the nep number, a measuring member 38 for detecting the fiber length and a setting member 39 (for example, the drive motor 40) are connected to an electronic control and regulating device 36, such as a microcomputer. The measuring values for the fiber lengths which, for example, may be determined by a fibrograph, may be inputted by an inputting device into the electronic control and regulating device 36. Further, a switching element, such as a pushbutton or the like may be coupled to the electronic control and regulating device 36 with which the motor 40 may be actuated. Further, a measuring member 41 such as a FLATCONTROL FCT, manufactured by Trützschler GmbH & Co. KG may be connected to the electronic control and regulating device 36 to detect the distance a between the imaginary circles 21 and 22 representing the points of the flat bar clothings 14*d* and the points of the cylinder clothing 4*a*, respectively.

Figure 15:
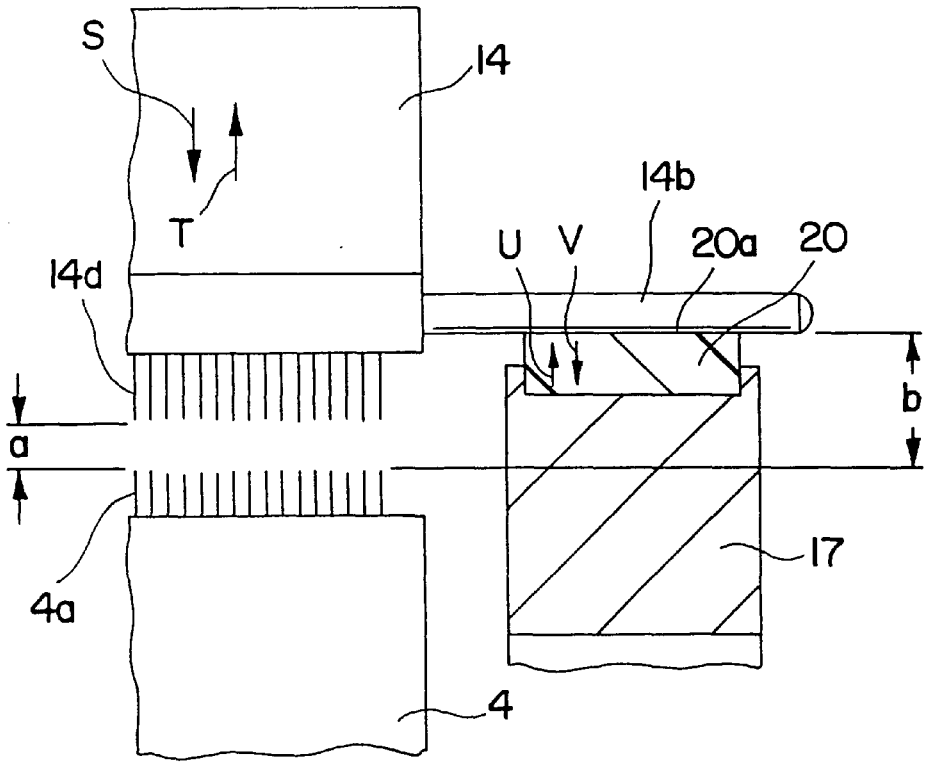
FIG. 15 is a schematic sectional front elevational view of a flat bar cooperating with a carding cylinder and supported on a slide guide.

Turning to FIG. 15 and also referring to FIGS. 2, 9*a* and 9*b*, if the slide guide 20 is shifted from its position shown in FIG. 9*a* in the direction of the arrow A into the position shown in FIG. 9*b*, the convex outer surface 20*a* is displaced in the direction of the arrow U upwardly, so that the radial distance b between the flat bar-supporting surface 20*a* of the slide guide 20 and the points of the clothing 4*a* of the carding cylinder 4 increases from $b_1$ to $b_2$. At the same time, the flat bars 14, supported on the slide guide 20 by pins 14*b*, are also displaced radially upwardly in the direction of the arrow T, so that the distance a between the points of the flat bar clothings 14*d* and the points of the cylinder clothing 4*a* increases from $a_1$ to $a_2$. A corresponding decrease of a and b occurs if the slide guide is shifted in the direction B.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder having a cylinder axis and carrying a cylinder clothing on a circumferential surface thereof; said cylinder clothing having clothing points;

(b) traveling flats cooperating with said main carding cylinder along a circumferential length portion thereof; said traveling flats including (1) a plurality of flat bars each having a flat bar clothing cooperating with said cylinder clothing; said flat bar clothing having clothing points; and (2) drive means for moving said flat bars in unison in an endless path having a working leg in which said flat bar clothings cooperate with said cylinder clothing and a return leg; said working leg extending circumferentially about a portion of said main carding cylinder;

(c) a flexible bend supported on a machine frame laterally of said main carding cylinder; said flexible bend having a convex surface;

(d) a slide guide supported on said flexible bend; said slide guide having a convex surface supporting said flat bars for sliding motion thereon along said working leg; a radial position of said convex surface of said slide guide relative to said cylinder axis determining a radial clothing point distance between the clothing points of said flat bar clothings and the clothing points of said cylinder clothing; and (e) adjusting means for circumferentially displacing said slide guide such that said radial clothing point distance remains uniform at all locations along said working leg.

2. A carding machine comprising (a) a main carding cylinder having a cylinder axis and carrying a cylinder clothing on a circumferential surface thereof; said cylinder clothing having clothing points;

(b) traveling flats cooperating with said main carding cylinder along a circumferential length portion thereof; said traveling flats including (1) a plurality of flat bars each having a flat bar clothing cooperating with said cylinder clothing; said flat bar clothing having clothing points; and (2) first drive means for moving said flat bars in unison in an endless path having a working leg in which said flat bar clothings cooperate with said cylinder clothing and a return leg; said working leg extending circumferentially about a portion of said main carding cylinder;

(c) a flexible bend supported on a machine frame laterally of said main carding cylinder; said flexible bend having a convex surface;

(d) a slide guide supported on said flexible bend; said slide guide having a convex surface supporting said flat bars for sliding motion thereon along said working leg; a radial position of said convex surface of said slide guide relative to said cylinder axis determining a radial clothing point distance between the clothing points of said flat bar clothings and the clothing points of said cylinder clothing; and (e) adjusting means for radially displacing said slide guide such that said radial clothing point distance remains uniform at all locations along said working leg; said adjusting means including (1) a first elongated element positioned in said working leg and having convex outer and inner surfaces extending along said circumferential length portion of said main carding cylinder; a first radial distance between said convex outer surface and said concave inner surface of said first elongated element decreasing as viewed in a selected circumferential direction;

(2) a second elongated element positioned in said working leg and having a convex outer surface extending along said circumferential length portion of said main carding cylinder; said convex outer surface of said second elongated element being disposed face-to-face with said concave inner surface of said first elongated element; a second radial distance between said convex outer surface of said second elongated element and said cylinder axis increasing as viewed in said selected circumferential direction such that for any selected relative circumferential position between said first and second elongated elements the sum of said first and second distances is constant at any circumferential location along said first and second elongated elements; and (3) second drive means for circumferentially displacing at least one of said first and second elongated elements relative to the other of said first and second elongated elements.

3. The carding machine as defined in claim 2, wherein said first and second distances vary uniformly as viewed circumferentially.

4. The carding machine as defined in claim 2, wherein said concave inner surface of said first elongated element is in a face-to-face engagement with said convex outer surface of said second elongated element.

5. The carding machine as defined in claim 2, further comprising an intermediate member disposed between said slide guide and said flexible bend; said intermediate member having a convex outer surface being face-to-face with said concave inner surface of said slide guide; said intermediate member having a concave inner surface being face-to-face with said convex outer surface of said flexible bend; said slide guide forming said first elongated element and said intermediate member forming said second elongated element.

6. The carding machine as defined in claim 2, wherein said second drive means comprises (a) a toothed rack carried by one of said first and second elongated elements;

(b) a pinion meshing with said toothed rack; and (c) a motor driving said pinion for circumferentially displacing said one elongated element.

7. The carding machine as defined in claim 2, wherein one of said first and second elongated elements has flexible opposite end portions; further wherein said second drive means comprises winches for winding and unwinding said flexible end portions for circumferentially shifting said one elongated element.

8. The carding machine as defined in claim 2, wherein one of said first and second elongated elements is an endless belt; further comprising belt supporting rollers for positioning said one elongated element; further wherein said second drive means is operatively coupled to said endless belt for displacing said endless belt in a circulating path.

9. The carding machine as defined in claim 2, further comprising an electronic control and regulating device connected to at least one of a motor forming part of said second drive means, a measuring member for detecting fiber lengths, a measuring member for detecting the nep number of the fiber, a measuring member for detecting said radial point distance, a switching element for actuating said motor, and an inputting element applying fiber length data.

10. The carding machine as defined in claim 2, further comprising a circumferentially extending groove provided in said convex outer surface of said flexible bend; one of said elongated elements being received in said groove and being guided by said side walls.

11. The carding machine as defined in claim 2, wherein at least one of said elongated elements is flexible and is of one of metal and plastic.

12. The carding machine as defined in claim 2, wherein said slide guide forms said first elongated element and said flexible bend forms said second elongated element.

13. The carding machine as defined in claim 12, further comprising a circumferentially extending groove provided in said convex outer surface of said flexible bend; said groove having a circumferentially convex groove bottom; said slide guide being received in said groove; said concave inner surface of said slide guide being in a face-to-face engagement with said convex groove bottom.

14. The carding machine as defined in claim 2, further comprising an intermediate member disposed between said slide guide and said flexible bend; said intermediate member having a convex outer surface being face-to-face with said concave inner surface of said slide guide; said intermediate member having a concave inner surface being face-to-face with said convex outer surface of said flexible bend; said intermediate member forming said first elongated element and said flexible bend forming said second elongated element.

15. The carding machine as defined in claim 14, further comprising a circumferentially extending groove provided in said convex outer surface of said flexible bend; said groove having a circumferentially convex groove bottom; said intermediate member being received in said groove; said concave inner surface of said intermediate member being in a face-to-face engagement with said convex groove bottom.

16. The carding machine as defined in claim 2, further comprising first and second intermediate members disposed between said slide guide and said flexible bend; said first and second intermediate members each having a convex outer surface and a convex inner surface; said convex outer surface of said first intermediate member being face-to-face with said concave inner surface of said slide guide; said concave inner surface of said first intermediate member being face-to-face with said convex outer surface of said second intermediate member; said concave inner surface of said second intermediate member being face-to-face with said outer convex surface of said flexible bend; said first intermediate member forming said first elongated element and said second intermediate member forming said second elongated element.

17. The carding machine as defined in claim 16, further comprising a circumferentially extending groove provided in said convex outer surface of said flexible bend; said groove having a circumferentially convex groove bottom; said second intermediate member being received in said groove; said concave inner surface of said second intermediate member being in a face-to-face engagement with said convex groove bottom.

18. The carding machine as defined in claim 2, further comprising an intermediate member disposed between said slide guide and said flexible bend; said intermediate member having a convex outer surface and a concave inner surface; said intermediate member forming one of said first and second elongated elements.

19. The carding machine as defined in claim 18, wherein said intermediate member is flexible.

20. The carding machine as defined in claim 19, wherein said intermediate member is a metal band.

21. A carding machine comprising (a) a main carding cylinder having a cylinder axis and carrying a cylinder clothing on a circumferential surface thereof; said cylinder clothing having clothing points;

(b) traveling flats cooperating with said main carding cylinder along a circumferential length portion thereof; said traveling flats including (1) a plurality of flat bars each having a flat bar clothing cooperating with said cylinder clothing; said flat bar clothing having clothing points; and (2) drive means for moving said flat bars in unison in an endless path having a working leg in which said flat bar clothings cooperate with said cylinder clothing and a return leg; said working leg extending circumferentially about a portion of said main carding cylinder;

(c) a flexible bend supported on a machine frame laterally of said main carding cylinder; said flexible bend having a convex surface;

(d) a slide guide supported on said flexible bend; said slide guide having a convex surface supporting said flat bars for sliding motion thereon along said working leg; a radial position of said convex surface of said slide guide relative to said cylinder axis determining a radial clothing point distance between the clothing points of said flat bar clothings and the clothing points of said cylinder clothing; and (e) adjusting means for radially displacing said slide guide such that said radial clothing point distance remains uniform at all locations along said working leg; said adjusting means including shiftable means displaceable along said circumferential surface of said main carding cylinder for radially displacing said slide guide by camming action.

* * * * *